US008234804B1

(12) United States Patent
Rush

(10) Patent No.: US 8,234,804 B1
(45) Date of Patent: Aug. 7, 2012

(54) LASER ETCHED ARTICLE WITH ILLUMINABLE HOUSING

(76) Inventor: Janet Rush, Brooklyn, NY (US)

( * ) Notice: Subject to any disclaimer, the term of this patent is extended or adjusted under 35 U.S.C. 154(b) by 23 days.

(21) Appl. No.: 11/141,075

(22) Filed: May 31, 2005

(51) Int. Cl.
*G09F 13/18* (2006.01)

(52) U.S. Cl. ..... 40/546; 40/547

(58) Field of Classification Search ..... 40/546
See application file for complete search history.

(56) References Cited

U.S. PATENT DOCUMENTS

| | | | | |
|---|---|---|---|---|
| 2,623,313 | A * | 12/1952 | Fuchs | 40/546 |
| 3,220,130 | A | 11/1965 | Falkenburg | |
| 4,974,354 | A * | 12/1990 | Hembrook, Jr. | 40/546 |
| 5,099,592 | A | 3/1992 | Layne | |
| 5,255,170 | A | 10/1993 | Plamp et al. | |
| 5,369,553 | A * | 11/1994 | Trusiani | 362/604 |
| 5,822,898 | A | 10/1998 | Weissleder | |
| 5,842,297 | A * | 12/1998 | Tung | 40/546 |
| 6,082,880 | A | 7/2000 | Nerlino et al. | |
| 6,254,796 | B1 | 7/2001 | Rath et al. | |
| 6,308,444 | B1 * | 10/2001 | Ki | 40/546 |
| 6,481,131 | B2 * | 11/2002 | Gianotti et al. | 40/546 |
| 6,544,634 | B1 | 4/2003 | Abrams et al. | |
| 6,617,541 | B1 | 9/2003 | Wadman et al. | |
| 6,672,738 | B1 | 1/2004 | Lewis et al. | |
| 7,024,809 | B1 * | 4/2006 | Poma | 40/546 |
| 7,418,795 | B2 * | 9/2008 | Caarls et al. | 40/546 |
| 2002/0157292 | A1 * | 10/2002 | Landers et al. | 40/546 |
| 2003/0046842 | A1 * | 3/2003 | Maas et al. | 40/546 |
| 2004/0045199 | A1 * | 3/2004 | Ki | 40/546 |
| 2005/0088850 | A1 * | 4/2005 | Miller | 362/503 |

FOREIGN PATENT DOCUMENTS

| | | |
|---|---|---|
| GB | 2.094.622 | 9/1982 |
| WO | WO03/036159 | 5/2003 |

* cited by examiner

*Primary Examiner* — Casandra Davis
(74) *Attorney, Agent, or Firm* — Michael I. Kroll

(57) ABSTRACT

An etched display incorporating lighting within a housing. A translucent material has a laser-etching of an image that is placed within the stand with at least one edge of the translucent article facing a lighting source whereby the light rays create a translucent article having a higher luminance than the ambient surroundings.

2 Claims, 8 Drawing Sheets

LASER ETCHED ARTICLE WITH ILLUMINABLE HOUSING

BACKGROUND OF THE INVENTION

1. Field of the Invention

The present invention relates generally to displays and, more specifically, the present invention comprises the combination of laser etching an image in a translucent material, such as glass and acrylic, and illuminating said etched image by means of track-like lighting within a housing designed to engage some portion of the material edge of the etched article including encompassing the periphery of the etched article regardless of shape.

The track housing incorporates a cavity for receiving the article(s) to be illuminated by a any suitable illuminable element, such as LEDs or fiber optics capable of generating light particles that are emitted to travel through the translucent material edgewise creating a unique method of illuminating laser etched images.

Varying the LED array or color of the illuminable elements within the housing and/or layering articles to be illuminated or portioning the article receptacle to receive a plurality of articles to be illuminated edgewise are variations of the process of edgewise illumination provided for within the scope of the present invention, including the aforementioned encompassing the article to be illuminated throughout the periphery thereby providing even distribution of light throughout the etched material and defining the shape as amorphous, limited only to the creativity of the designer.

The electrical power source for the illuminable elements can be either AC or DC and the light housing can be free standing, as well as incorporate means for fastening to horizontal or vertical surfaces with the illuminated article(s) depending therefrom.

2. Description of the Prior Art

There are other etched materials designed for display. Typical of these is U.S. Pat. No. 3,220,130 issued to Falkenberg on Nov. 30, 1965.

Another patent was issued to Layne on Mar. 31, 1992 as U.S. Pat. No. 5,099,592. Yet another U.S. Pat. No. 5,255,170 was issued to Plamp et al. on Oct. 19, 1993 and still yet another was issued on Oct. 20, 1998 to Weissleder as U.S. Pat. No. 5,822,898.

Another patent was issued to Nerlino et al. on Jul. 4, 2000 as U.S. Pat. No. 6,082,880. Yet another U.S. Pat. No. 6,254,796 was issued to Rath et al. on Jul. 3, 2001. Another was issued to Abrams et al. on Apr. 8, 2003 as U.S. Pat. No. 6,544,634 and still yet another was issued on Sep. 9, 2003 to Wadman et al. as U.S. Pat. No. 6,617,541.

Another patent was issued to Lewis et al. on Jan. 6, 2004 as U.S. Pat. No. 6,672,738. Yet another U.K. Patent No. GB2094622 was issued to Chiang on Sep. 22, 1982. Another was published to Jacob on May 1, 2003 as International Patent Application No. WO03/036159.

U.S. Pat. No. 3,220,130

Inventor: Gustave F. Falkenberg

Issued: Nov. 30, 1965

In an illuminated display the combination comprising: a translucent display panel having a peripheral edge including a horizontal bottom edge; a molded thin-shell light reflective back panel formed from a-thermoplastic sheet material which has a peripheral edge secured contiguously to the peripheral edge of said display panel and from which the sheet material recedes rearwardly to form a cavity with generally concave sloping wall surfaces running inwardly from such edge to a central vertical crest, said crest provided at its upper limits with an opening and having a flat downwardly extending portion beneath said opening and including vertically disposed external undercut grooves on opposite sides thereof, said undercut grooves being open along the outer lateral sides of said flat portion and being open at the bottom of said flat portion; a stand having a pair of spaced rod members for insertion in said undercut grooves for gripping engagement of said crest, a tie bar means joining said rods at their lower ends to rest against said back panel beneath said grooves, said stand having side members extending downwardly from said lower ends of said rods and terminating in a foot support portion spaced rearwardly from the horizontal bottom edge of said display panel for upright support of the display; a reinforcing member on the interior of said flat portion retained between said flat portion and the opposing inwardly extending interior surfaces of said undercut grooves; and means disposed within said opening for mounting a bulb within the cavity formed in said back panel to direct light over the interior surface of said back panel and to substantially the entire peripheral edge thereof.

U.S. Pat. No. 5,099,592

Inventor: Clifford J. Layne

Issued: Mar. 31, 1992

An illuminated sign comprises front and back sheets central portions of which are generally planar. The front sheet carries design elements thereon certain of which are intended to be highlighted. The back sheet has portals therein generally opposed to the areas to be highlighted and which are closed by flaps which may form a unitary part of the back sheet. The portals provide access to lamps contained within the sign. The sign is easily mounted from a ground surface and is economic to manufacture for use as a seasonal decoration.

U.S. Pat. No. 5,255,170

Inventor: Diann F. Plamp

Issued: Oct. 19, 1993

A memorial comprising a three dimensional monument member having a configuration and first surface conforming to said configuration, an illuminating means, coupled to a first surface of said monument member, for illuminating said monument, said illuminating means including a plurality of light sources arranged on said first surface to substantially conform to said configuration. The memorial further includes power means, electrically coupled to said illumination means, for providing said electrical power, and control means, electrically coupled to said illumination means and said power means, for responsively coupling said electrical power to said illuminating means and wherein said plurality of light sources, when illuminated, radiate outward appearing as illuminating star-like light sources.

U.S. Pat. No. 5,822,898

Inventor: Kenneth L. Weissleder

Issued: Oct. 20, 1998

A point of sale unit is disclosed comprising a platform which supports an actual product on sale. The platform has a horizontal support panel, a front panel and side panels. A pictorial sculpture is on the front panel having a theme related to the product. A plurality of lights mounted in a line along part of the pictorial sculpture are repeatedly flashed in sequence by a light flashing circuit. The pictorial sculpture comprises a photo print of a subject related to the product which is screen printed onto acrylic plastic with its outer edges conforming to the outer edges of the subject of the photo print. A pressure sensitive switch mounted on the platform operates the flashing lights only when the product is supported on the horizontal support panel. A manually-operable switch is in parallel with the pressure sensitive switch so that the repeatedly flashing lights may be operated when the product is not supported by the horizontal support panel.

U.S. Pat. No. 6,082,880

Inventor: Mike Nerlino

Issued: Jul. 4, 2000

An illuminated roof ornament attachment for attaching to the roof of a vehicle in a funeral procession. The attachment includes a base designed for attachment to an exterior surface of a vehicle and an ornament upwardly extended from the base. The ornament comprises a translucent material for permitting passage of light therethrough. A light source is provided in the ornament for illuminating the ornament.

U.S. Pat. No. 6,254,796

Inventor: David L. Rath

Issued: Jul. 3, 2001

A silicate glass is selectively etched employing a composition containing a fluoride containing compound and certain organic solvents. Preferred compositions also include water.

U.S. Pat. No. 6,544,634

Inventor: Frederic Louis Abrams

Issued: Apr. 8, 2003

An in-mold and in-line decorating method is disclosed which, using a single sheet layer, allows the placement of the highest possible quality graphics into the surface of products made from a variety of moldable thermoplastic, thermoset, and vulcanizable materials using a variety of molding processes. The methods also provide new or improved capabilities for product identification, safety, and serialized tracking.

U.S. Pat. No. 6,617,541

Inventor: Sipke Wadman

Issued: Sep. 9, 2003

A method of furnishing a substrate with a patterned film of electrode material making use of a laser beam, whereby a stack is made by providing a surface of the substrate at least with a layer of an assistant material and an overlying layer of the said electrode material, the assistant material being capable of decomposition upon heating with the aid of the said laser beam, subsequent to which the stack is, in accordance with a desired pattern, locally irradiated with the laser beam so as to heat the assistant material to at least its decomposition temperature, consequent upon which the locally overlying electrode material is caused to detach.

U.S. Pat. No. 6,672,738

Inventor: James M. Lewis

Issued: Jan. 6, 2004

The invention relates to a decorative ornament. The ornament includes a circuit board shaped in an aesthetically desirable manner to provide a background for the decorative ornament, a plurality of light sources, an integrated circuit and circuit leads being mounted on the circuit board. The circuit leads electrically couple the light sources with the integrated circuit to control the light pattern displayed by the decorative ornament. The circuit leads, light sources and circuit boards working together to create an aesthetically pleasing ornament.

U.K. Patent Number GB2094622

Inventor: Liu Yiu Ching

Published: Sep. 22, 1982

An illuminated display, particularly a festive decoration such as a Christmas tree, formed of printed circuit board to which are attached one or more light emitting diodes.

International Patent Application Number WO03/036159

Inventor: Stephane Frederick Jacob

Issued: May 1, 2003

The invention relates to a decorative ornament. The ornament includes a circuit board shaped in an aesthetically desirable manner to provide a background for the decorative ornament, a plurality of light sources, an integrated circuit and circuit leads being mounted on the circuit board. The circuit leads electrically couple the light sources with the integrated circuit to control the light pattern displayed by the decorative ornament. The circuit leads, light sources and circuit boards working together to create an aesthetically pleasing ornament.

While these devices may be suitable for the purposes for which they were designed, they would not be as suitable for the purposes of the present invention, as hereinafter described.

SUMMARY OF THE PRESENT INVENTION

A primary object of the present invention is to provide an article comprised of a translucent material having a laser etched image therein placed within a lighted housing.

Another object of the present invention is to provide a housing having a planar base and an upwardly extending cavity forming a receptacle for the laser etched translucent display member.

Yet another object of the present invention is to provide lighting elements within the base of the housing.

Still yet another object of the present invention is to provide a housing having connecting with an AC power source or incorporates DC power source.

Additional objects of the present invention will appear as the description proceeds.

The present invention overcomes the shortcomings of the prior art by providing an etched display incorporating lighting within a housing. A translucent material has a laser etching of an image that is placed within the stand with at least one edge of the translucent article facing a lighting source whereby the light rays create a translucent article having a higher luminence than the ambient surroundings.

The present invention comprises the combination of laser etching an image in a translucent material, such as glass and acrylic, and illuminating said etched image by means of track-like lighting within a housing designed to engage some portion of the material edge of the etched article including encompassing the periphery of the etched article regardless of shape.

The track housing incorporates a cavity for receiving the article(s) to be illuminated by illuminable elements, such as LEDs or fiber optics, generating light particles that are emitted to travel through the translucent material edgewise creating a unique method of illuminating laser etched images.

Varying the led array or color of the illuminable elements within the housing and/or layering articles to be illuminated or portioning the article receptacle to receive a plurality of articles to be illuminated edgewise are variations of the process of edgewise illumination provided for within the scope of the present invention, including the aforementioned encompassing the article to be illuminated throughout the periphery thereby providing even distribution of light throughout the etched material and defining the shape as amorphous, limited only to the creativity of the designer.

The electrical power source for the illuminable elements can be either AC or DC and the light housing can be free standing, as well as, incorporate means for fastening to horizontal or vertical surfaces with the illuminated article(s) depending therefrom.

The light base can be positioned in one of the following ways:

a) Single Base—at either bottom, top or any side (left or right) (for smaller images), thus creating ability for the article to be either free standing, wall mounted, or ceiling mounted.

b) Double Base (for larger images)—can be positioned at either top and bottom, or at both sides (left and right) therefore creating the article that can be either wall or ceiling mount, and free standing.

c) Frame/Base with lights all around—for largest images (4'×8') and beyond. The source of light to be at the perimeter of the laser etched acrylic or glass, thus creating even distribution of light throughout the etched material. This application is widely used for either wall mount or partition mount.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
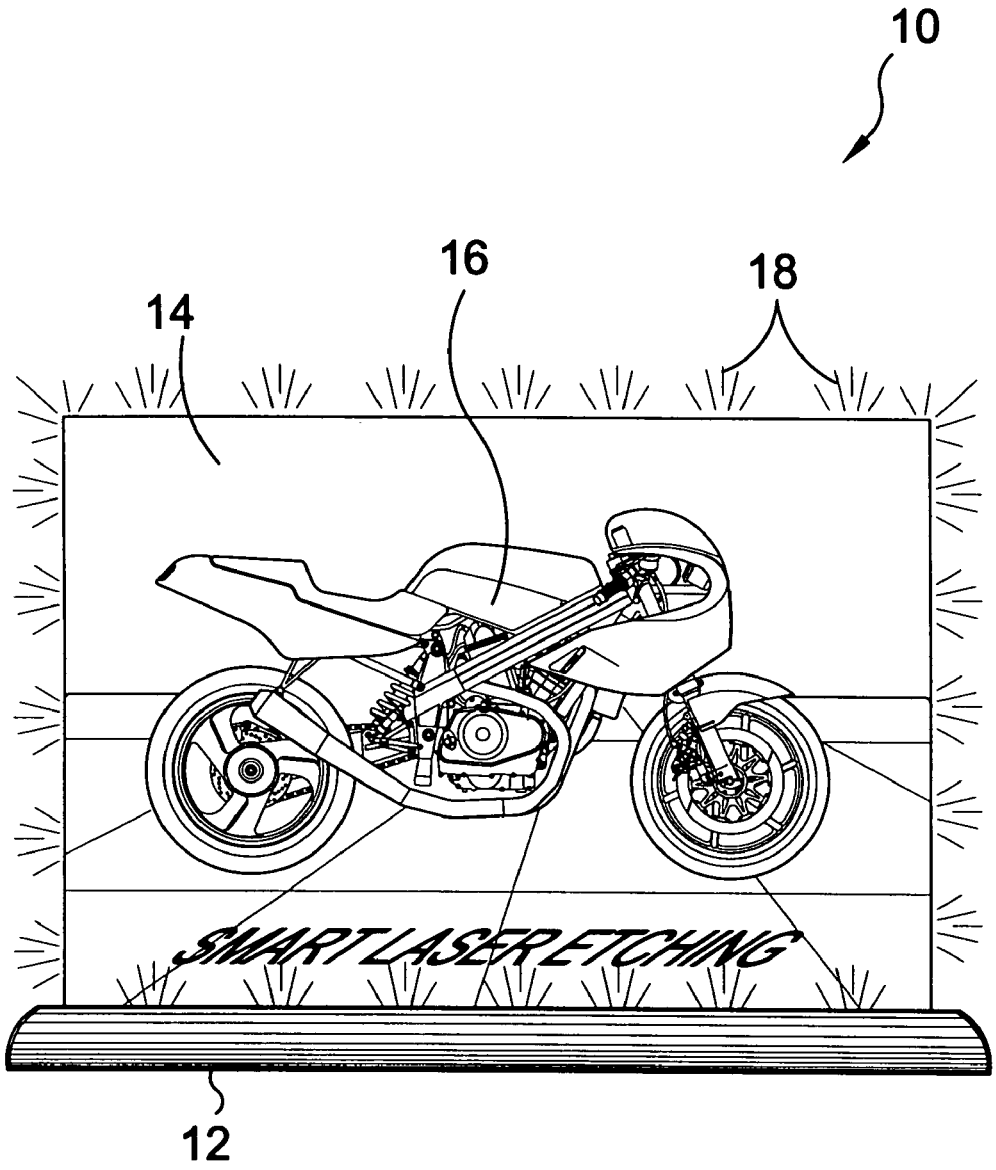
FIG. 1 is an illustrative view of the present invention.

Turning now descriptively to the drawings, in which similar reference characters denote similar elements throughout the several views, the figures illustrate the Laser-Etched Article with Illuminable Housing of the present invention. With regard to the reference numerals used, the following numbering is used throughout the various drawing figures.

10 Laser-Etched Article with Illuminable Housing of the present invention
12 illuminable housing
14 transparent/translucent plate
16 laser-etched image
18 illumination
22 housing channel
24 light source
26 LED
28 power source
30 DC power source
32 AC power source
34 battery
36 power cord
38 electrical wire
40 light rays
42 refracted light rays

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention 10 comprises the combination of laser-etching an image 16 or indicia in a substantially planar translucent material, such as glass and acrylic, and illuminating said etched image by means of track-like lighting within an illuminable housing 12 designed to engage some portion of the etched article's material edge surface in part or in whole regardless of shape. Illustrated is one example of the implementation of the present invention 10 where an image 16 has been laser-etched into a translucent plate 14, such as glass or acrylic, and placed edgewise into a housing 12 having a plurality of illuminable elements that form a unique method of introducing illumination 18 to said laser-etched image 16.

The drawing figures show LEDs as the preferred lighting means, however any suitable light source, such as fiber optics, may be employed to achieve the objectives of the present invention 10.

Figure 2:
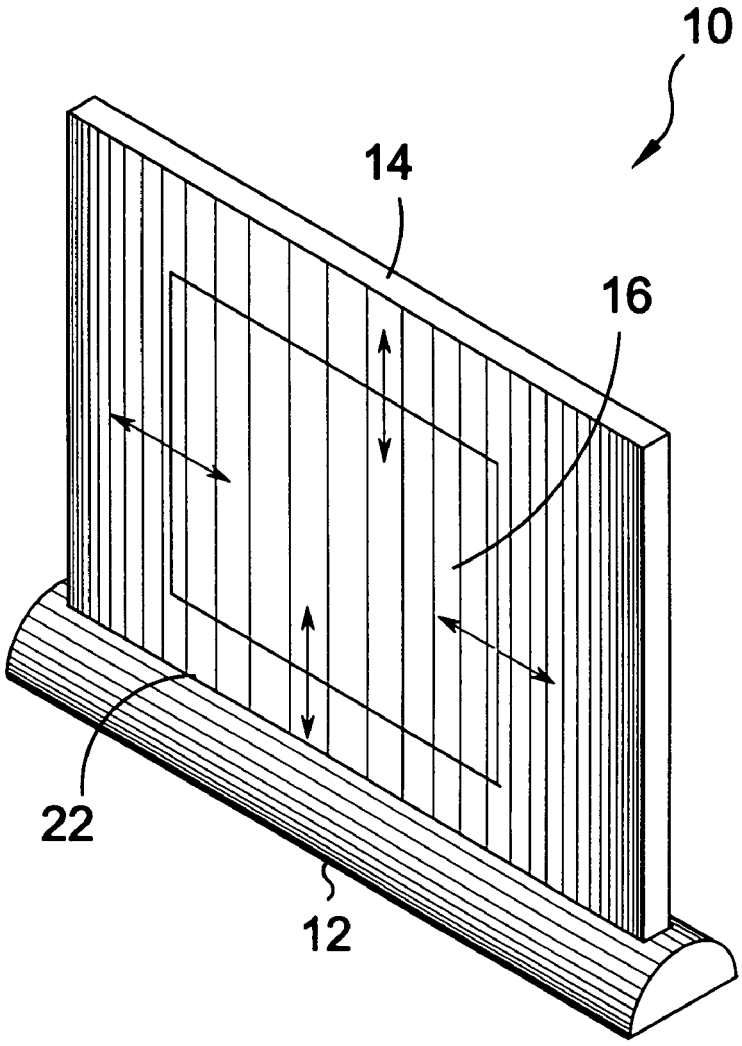
FIG. 2 is a perspective view of the present invention.

FIG. 2 is a perspective view of the present invention 10. The present invention 10 comprises the combination of laser-etching an image 16 into a plate 14 of translucent material, such as glass and acrylic, and illuminating said etched image by means of track-like lighting within a channel 22 in a housing 12 designed to engage some portion of the material edge of the etched plate 14 including encompassing the periphery of the etched plate 14 regardless of shape. The track housing 12 incorporates a channel 22 for receiving the plate (s) 14 to be illuminated by a plurality of illuminable elements, such as LEDs, generating light particles that are emitted to travel through the translucent material edgewise creating a unique method of illuminating laser-etched images 16. Varying the led array or color of the illuminable elements within the housing 12 and/or layering plates 14 to be illuminated or portioning the housing channel 22 to receive a plurality of plates to be illuminated edgewise are variations of the process of edgewise illumination provided for within the scope of the present invention 10, including the aforementioned encompassing the article to be illuminated throughout the periphery thereby providing even distribution of light throughout the etched material and defining the shape as amorphous, limited only to the creativity of the designer. The electrical power source for the illuminable elements can be either AC or DC and the light housing 12 can be free standing, as well as, incorporate means for fastening to horizontal or vertical surfaces with the illuminated article(s) depending therefrom.

Figure 3:
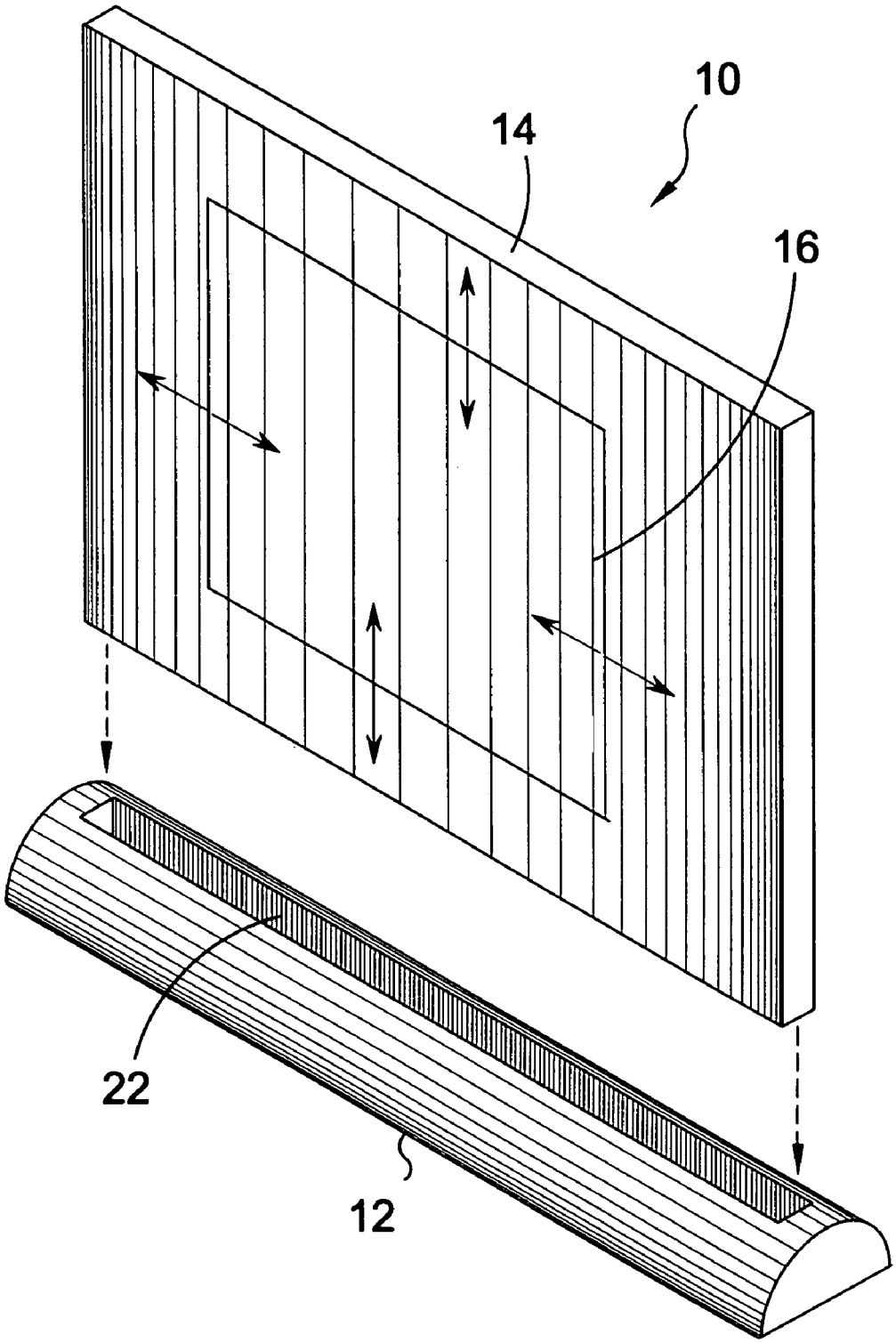
FIG. 3 is an exploded view of the present invention.

FIG. 3 is an exploded view of the present invention 10. Shown is an exploded view of the present invention 10, the combination of laser-etching an image 16 in a translucent plate 14 and illuminating said image 16 by means of an illuminable source within a housing 12 that can serve as a stand. The housing 12 has a channel 22 for receiving the translucent plate 14 having a plurality of illuminable elements positioned within the housing 12. The display can be powered by an external electric power source or battery.

Figure 4:
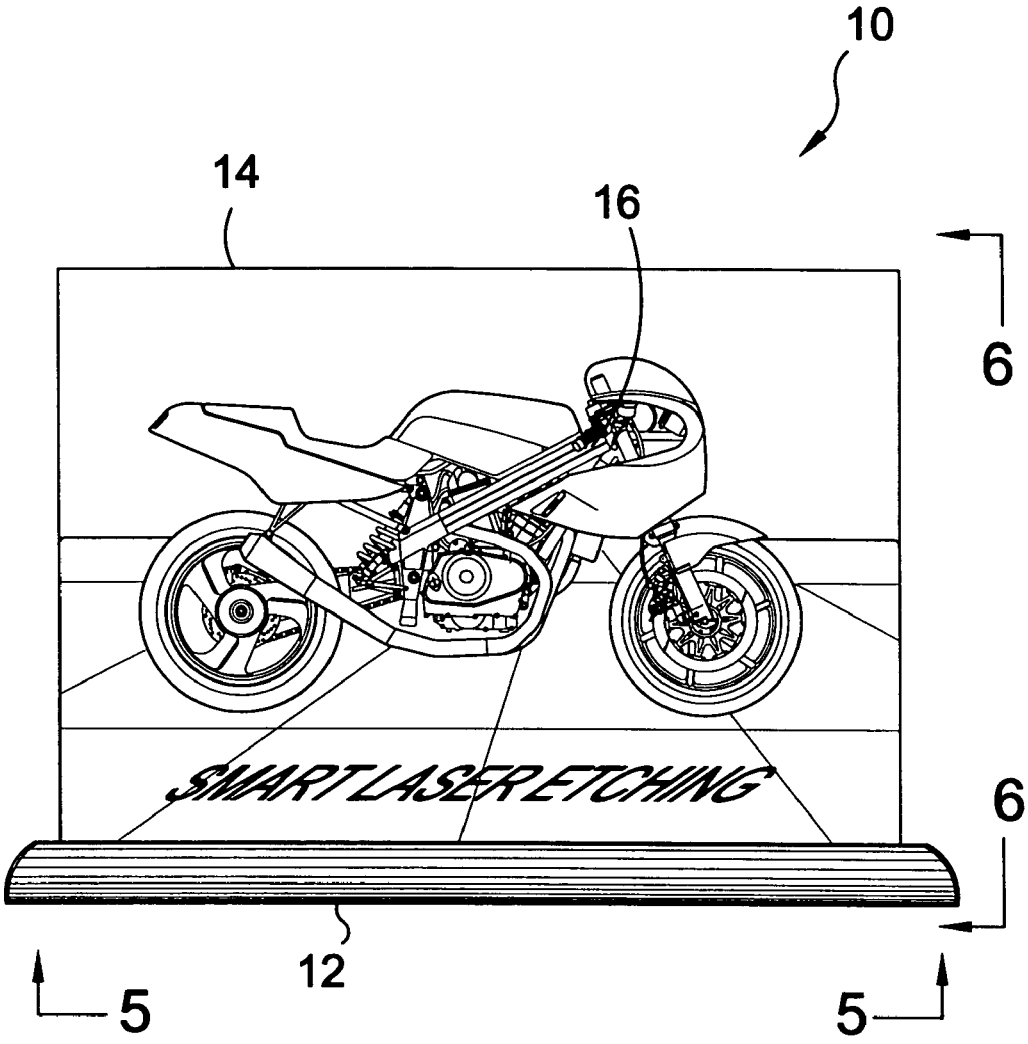
FIG. 4 is a planar view of the present invention.

FIG. 4 is a planar view of the present invention 10. Shown is a planar view of the present invention 10, the combination of laser-etching an image 16 in a translucent plate 14 and illuminating said image 16 by means of an illuminable housing 12. The housing 12 includes a channel 22 for receiving the translucent plates 14 and has a plurality of illuminable elements positioned within the housing 12. The device can be powered by an external electric power source or battery.

Figure 5:
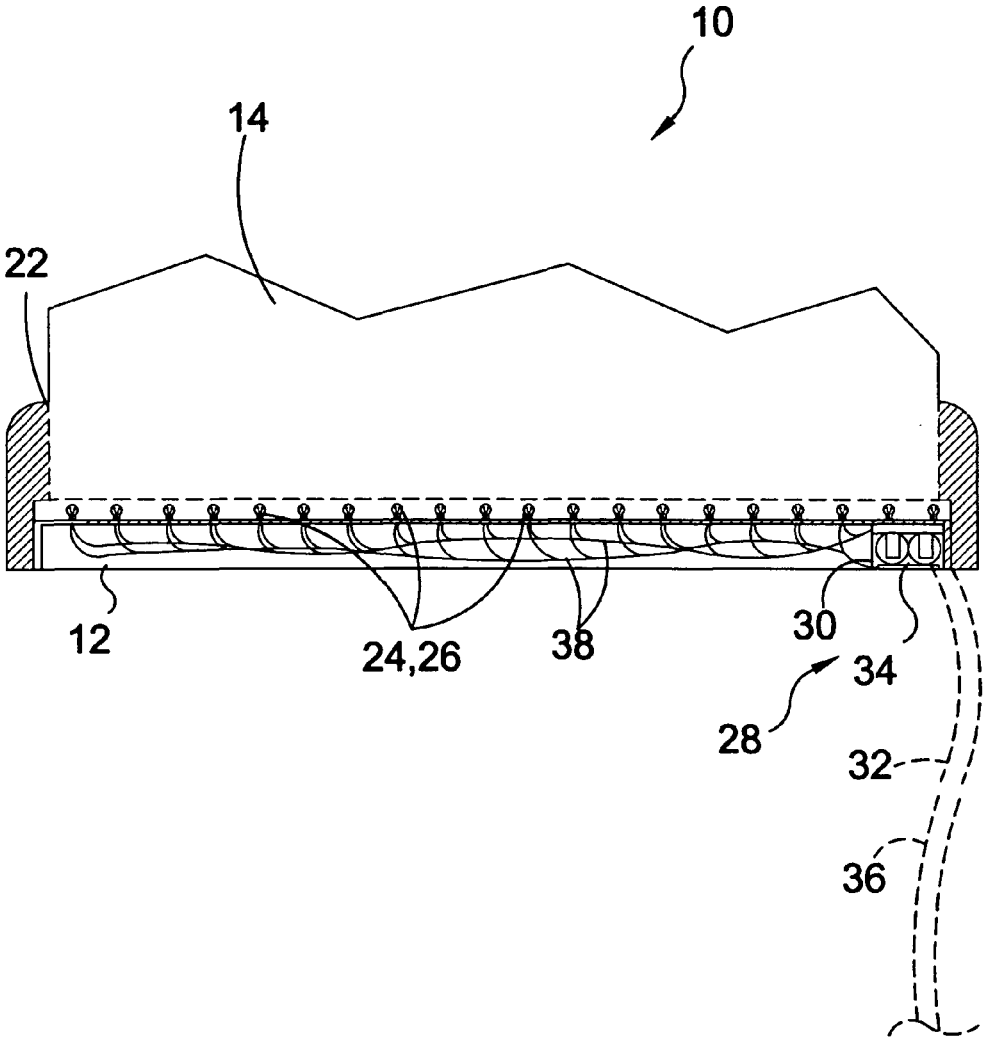
FIG. 5 is a sectional view of the present invention.

FIG. 5 is a sectional view of the present invention 10. Shown is an illustration of an embodiment employing a plurality of LEDs 26 as the light source 24 that when energized emit light beams that travel through the translucent plate 14 in the housing channel 22 from the bulb engaging side of the etched plate's edge creating a display having a higher light level than the ambient surroundings. The various laser-etched facets of the etched image 16 create a luminescent image. Shown is the housing having a plurality of power source 28 options including DC power 30 from at least one battery 34 and AC power 32 from a power cord 36. Electrical wiring 38 transfer power from the power source 28 to the LEDs 26.

Figure 6:
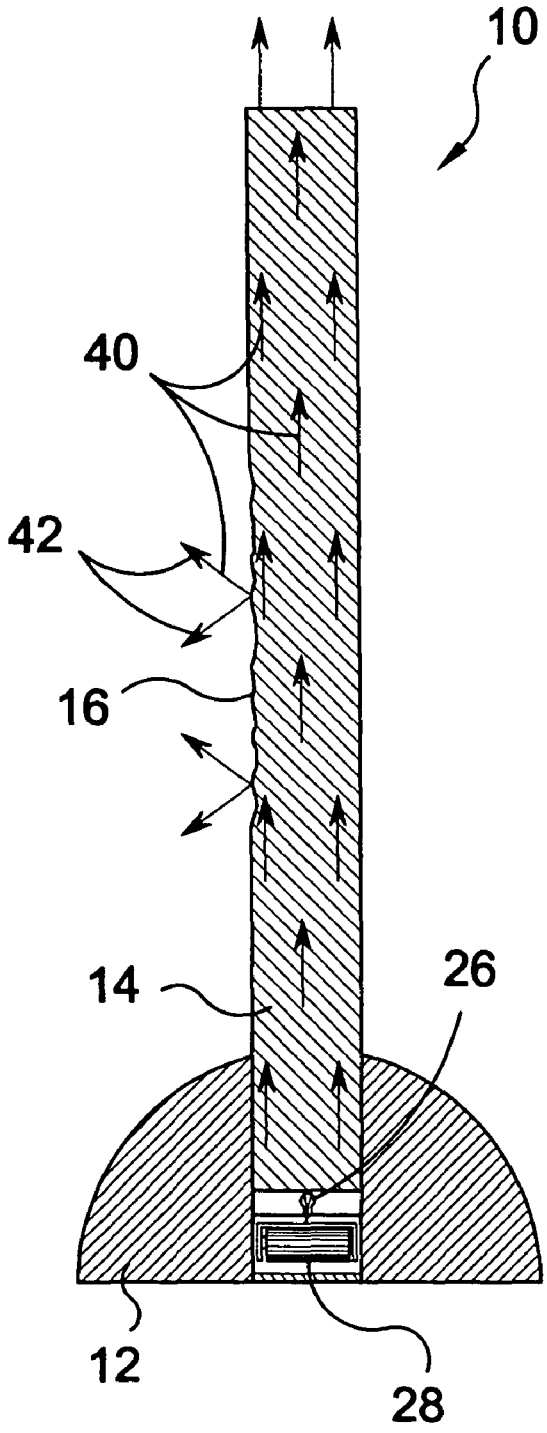
FIG. 6 is a sectional view of the present invention.

FIG. 6 is a sectional view of the present invention 10. The present invention 10 comprises the combination of laser-etching an image 16 in a translucent plate 14 and illuminating said image 16 by means of LEDs 26 disposed in an illuminable housing 12. The housing 12 has a channel for receiving the translucent plate 14 and houses a light source that selectively emits light beams 40 into the edge of the translucent plate 14 creating a display of higher luminescence than the ambient surroundings with the various etching facets emitting refracted light beams 42 creating a predetermined discernable creative image 16. The power source 28 can be derived from either ac or dc sources.

Figure 7:
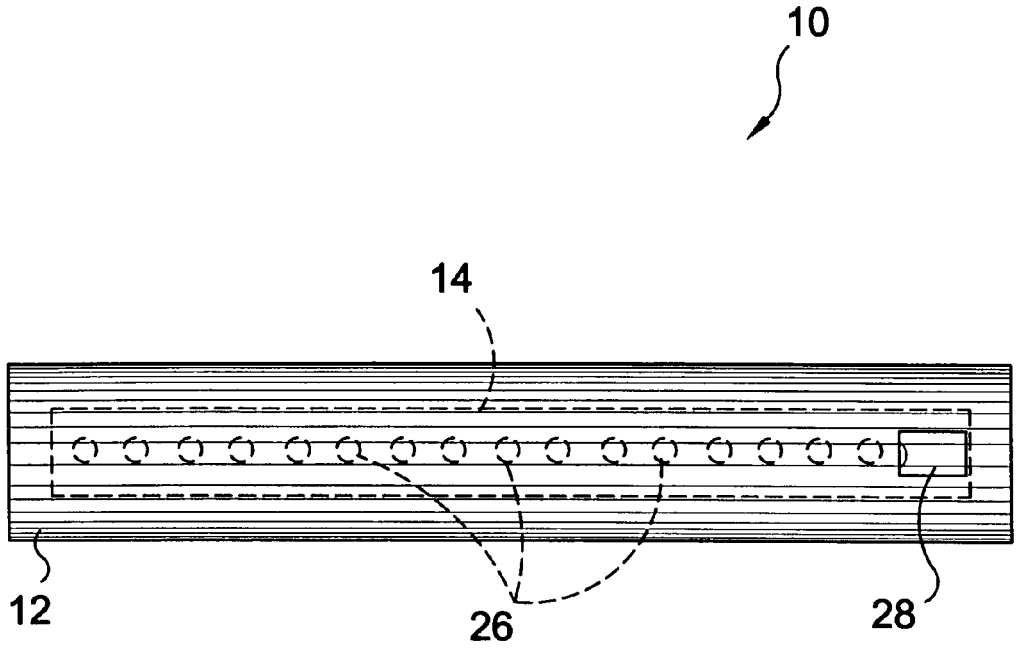
FIG. 7 is a bottom view of the housing portion of the present invention.

FIG. 7 is a bottom view of the base portion of the present invention 10. Illustrated is a housing 12 forming a base used as a stand. The present invention 10 provides for a housing having a footprint of appropriate size forming a stand for the etched plate 14 or a stand designed in a fashion more to accentuate the illuminated plate 14 as opposed to needed functional design. The present invention 10 provides the combination of laser etching an image in a plate 14 fabricated of a translucent material and illuminating said image by means of an illuminable housing 12. The housing 12 has a receptacle for receiving the translucent plate 14 and a plurality of illuminable LEDs 26 positioned within the housing 12. The device can be powered by an external or internal electric power source 30.

Figure 8:
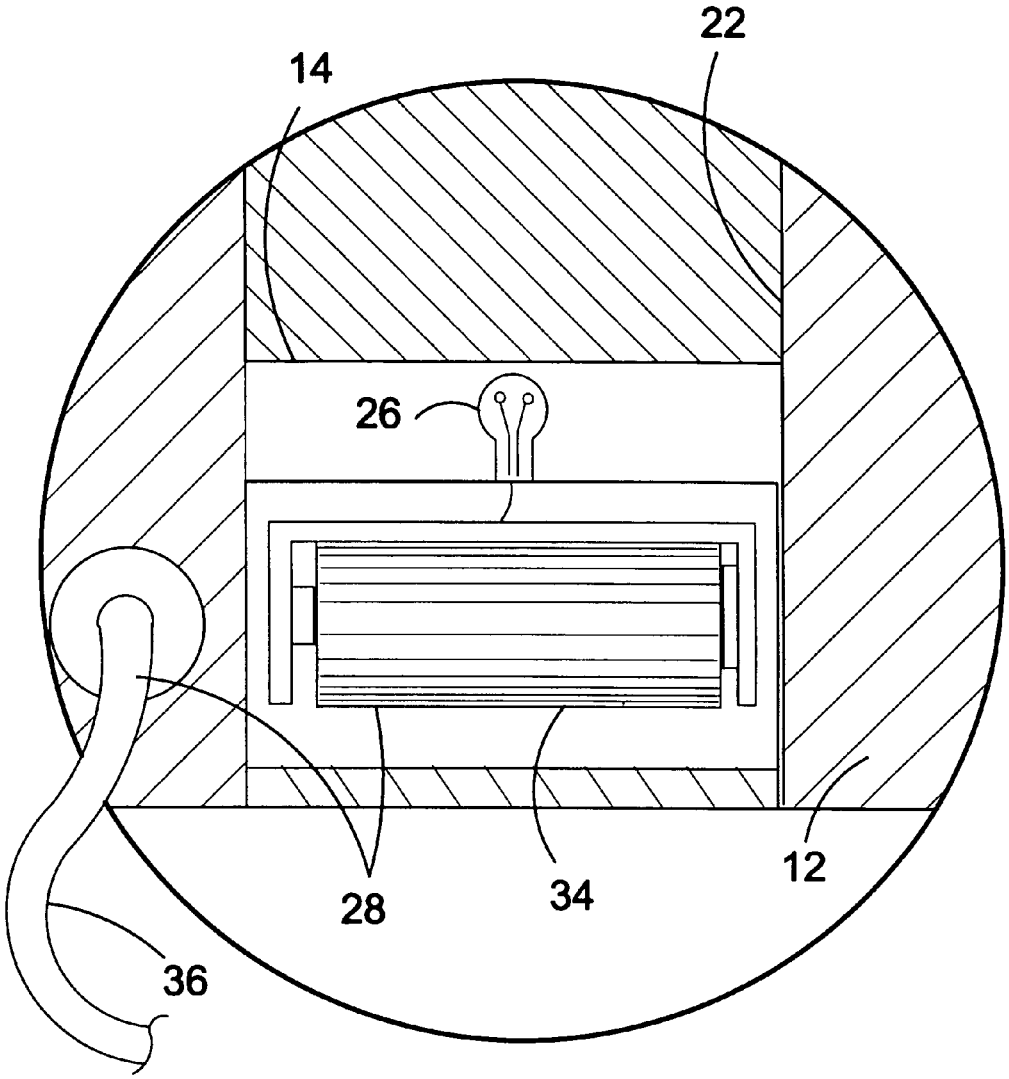
FIG. 8 is an enlarged sectional view of the housing incorporating illuminable elements.

FIG. 8 is an enlarged sectional view of the housing 12 incorporating LEDs 26 as the illuminable elements. Shown is a cutaway view of the housing 12 of the present invention having a channel 22 forming a receptacle for the placement therein of a translucent plate 14 having a laser-etched image thereon. The base of the receptacle channel 22 has a plurality of illuminable elements that when energized emit light beams that will travel into the translucent plate 14 from the edge facing the light emitting articles wherein the power source 28 can be derived from a DC battery 34 or receive AC power through a power cord 36

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A laser-etched article with illuminable housing consisting of:

a) a substantially solid, single planar plate of translucent material having top, bottom and side edges;

b) an uncovered etching on a front, viewable face of said plate, said etching formed of etching facets directing light away from said planar plate and not through said planar plate;

c) a housing having a completely surrounded channel forming a cavity for accepting and retaining said bottom edge of said plate, said housing being elongated with a flat bottom surface to support said housing and plate and a convex upper surface extending from one bottom edge of said housing to an opposite bottom edge of said housing completely surrounding said cavity, said convex upper surface having an opening into said cavity to receive said bottom edge of said plate extending into said cavity, said cavity having facing straight, vertically extending side walls, upper portions of said side walls being flush with a bottom portion of said plate, said cavity having a space directly below said plate, said housing serving as a stand to sit on a flat surface;

d) lighting means within said space in said cavity for selectively projecting light towards said plate wherein said light is refracted by said etching outwardly from said front, viewable face thereby producing the effect that said etching is highlighted and stands out from the rest of said plate, each said lighting means comprising a row of LED's projecting toward an edge of said plate;

e) all sides of said plate not contained within said cavity allowing light to escape from said plate; and f) said housing having a battery compartment and a power cord thereby providing user selectivity between AC and DC power sources, wherein the battery compartment is disposed in the housing below the LED's.

2. A laser-etched article with illuminable housing as recited in claim 1, wherein said etching is an image.

* * * * *